US007588078B2

(12) United States Patent
O'Brien

(10) Patent No.: US 7,588,078 B2
(45) Date of Patent: Sep. 15, 2009

(54) EXTENDED REACH ANCHOR

(75) Inventor: Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 88 days.

(21) Appl. No.: 11/346,093

(22) Filed: Feb. 2, 2006

(65) Prior Publication Data

US 2007/0175631 A1 Aug. 2, 2007

(51) Int. Cl.
*E21B 23/00* (2006.01)

(52) U.S. Cl. ..... 166/217; 166/206; 166/382

(58) Field of Classification Search ..... 166/382, 166/206, 212, 216, 217
See application file for complete search history.

(56) References Cited

U.S. PATENT DOCUMENTS 3,419,079 A * 12/1968 Current ..... 166/206
4,437,517 A * 3/1984 Bianchi et al. ..... 166/120
5,701,954 A 12/1997 Kilgore et al.
5,906,240 A * 5/1999 Kilgore et al. ..... 166/217
5,944,102 A * 8/1999 Kilgore et al. ..... 166/119
6,026,899 A * 2/2000 Arizmendi et al. ..... 166/216
6,241,017 B1 * 6/2001 Doane et al. ..... 166/134
6,715,560 B2 * 4/2004 Doane et al. ..... 166/387
6,719,063 B2 * 4/2004 Adams et al. ..... 166/382
6,793,022 B2 * 9/2004 Vick et al. ..... 166/382
6,877,567 B2 * 4/2005 Hirth ..... 166/382
6,920,927 B2 * 7/2005 Hirth ..... 166/206
6,926,087 B1 * 8/2005 Henke et al. ..... 166/382
6,935,423 B2 * 8/2005 Kusmer ..... 166/217
7,114,559 B2 * 10/2006 Sonnier et al. ..... 166/206
2004/0216893 A1 * 11/2004 Hirth ..... 166/382
2007/0175629 A1 * 8/2007 Harris ..... 166/117.6

* cited by examiner

*Primary Examiner*—Shane Bomar
(74) *Attorney, Agent, or Firm*—Steve Rosenblatt

(57) ABSTRACT

An anchor features a mandrel with ramps that extent through apertures in slip segments giving the slips a longer ramp to ride out on in a radial direction. The slip segments have ramps adjacent the apertures and in the preferred embodiment ride out on a plurality of spaced ramps on the mandrel.

15 Claims, 4 Drawing Sheets

EXTENDED REACH ANCHOR

FIELD OF THE INVENTION

The field of this invention is downhole anchors and more particularly those that are set in larger tubing than they are run through.

BACKGROUND OF THE INVENTION

Generally speaking anchors are bodies that have a series of slips that are retracted for running into a desired location and then have the slips extended to grip in the wellbore to support a tool or a string of tubulars or other downhole equipment. The objective in anchor design is to allow the tool to have the slimmest profile for insertion and then extend as much as possible for a grip, where the grip will still be strong enough to resist the anticipated loads.

U.S. Pat. No. 7,114,559 shows an anchor design in FIG. 2. The present invention is an improvement to that design. For completeness in understanding this invention FIGS. 1 and 2 will illustrate the preferred embodiment in the prior application to better provide a framework to understanding the present invention.

Thus, by way of background, FIGS. 1 and 2 will be reviewed to get an understanding of the present invention that has simply resulted in being able to extend the reach of an anchor for a given run in drift diameter to further than is possible with the design of FIGS. 1 and 2. FIG. 1 is a split view showing a slip in a retracted position for run in on the top half of the drawing and the same slip 10 in an extended position on the bottom half of FIG. 1. A jagged section line 2-2 in Figure indicates where on FIG. 1 the section shown in FIG. 2 is taken. What is shown is a mandrel 12 that has a series of ramps 14, 16 and 18. The mandrel 12 has a passage 20 through which pressure is put on a piston (not shown) that causes relative movement between the mandrel 12 and the slips 10 that are mounted to it. The mandrel 12 is shown to be symmetrical about the center line 22.

Slip 10 has ramps 24, 26 and 28 that rest against ramps 14, 16 and 18 for run in to create the smaller profile shown in FIG. 1. The inserts 30 stick out the most during run in and define the drift diameter necessary for the tool to pass on run in. The mandrel 12 has peaks set apart from each other and two of them 32 and 34 are shown in FIG. 1 that are disposed above and below ramp 16 for illustrative purposes. The slip 10 is an integral structure that spans over the ramps 14, 16 and 18 and is designed to have thin connecting segments such as 36 and 38 that meet design criteria. The Anchor design needs to consider the load to be applied, such as tensile loads through the mandrel 12, bearing area on slip 10 and ramp 16, and tensile loads through slip 10. Also, this should be designed within a small cross section dictated by the amount of travel needed. The segments 36 and 38 need to be thin to allow the tool to get through the smallest drift dimension possible. This is because the slips 10 are mounted fully over the mandrel 12 and the thicker they get in the connecting segments such as 36 and 38 the greater the drift will be required to run the tool downhole. The limiting value on how thin the segments 36 and 38 can get is how much tension load they have to take as the slip 10 rides out on the ramps on the mandrel 12. If the slip 10 doesn't move exactly evenly in its radial motion one or more segments get put under a temporary tensile load. Thus the segments must have sufficient cross-section to avoid failure from stressing during setting. The setting occurs when pressure is applied to passage 20 and relative movement of the slip segments 10 occurs with respect to mandrel 12. FIG. 2 shows a section view of the slip segment 10 retracted at the top and extended at the bottom. The section view is through the thin segment 36 shown in FIG. 1. Looking at the bottom of FIG. 1, it is easier to see that the most highly stressed portion of the slip 10 is at the thin segments such as 36 and 38 or the bearing area remaining between ramp 16 and slip 10. Ideally, the slip 10 has upper and lower ends that move in tandem in a radial direction but in reality due to irregularities in the surrounding tubular some portion of the slip 10 can engage at a different time than another portion to stress the thin segments such as 36 or 38.

Those skilled in the art will appreciate that although only a single slip 10 is shown in two positions in a split view that mandrel 12 supports a series of slips 10 around its circumference that are retained in a retracted position by one or more band springs (not shown).

The present invention optimizes the profile of the anchor so that the required drift dimension to run it in is kept to a minimum, while at the same time making it possible to extend the slips further into a larger tubular than the previous design and still get a good bite for support downhole. These and other aspects of the present invention will be more readily apparent to those skilled in the art from reviewing the description of the preferred embodiment and the drawings along with the claims, which are the full measure of the invention.

SUMMARY OF THE INVENTION

An anchor features a mandrel with ramps that extent through apertures in slip segments giving the slips a longer ramp to ride out on in a radial direction. The slip segments have ramps adjacent the apertures and in the preferred embodiment ride out on a plurality of spaced ramps on the mandrel.

DETAILED DESCRIPTION OF THE DRAWINGS

DETAILED DESCRIPTION OF THE PREFERRED EMBODIMENT

Figure 3:
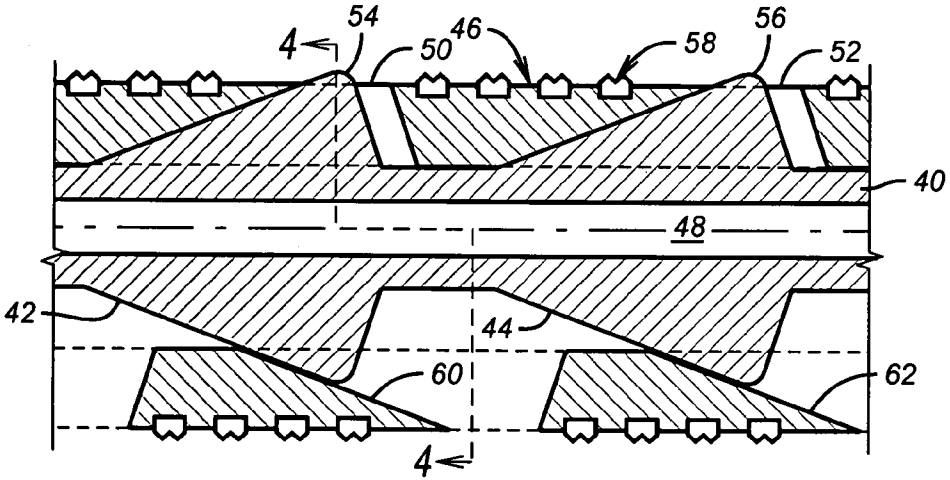
FIG. 3 is a split section view of the present invention showing the slip retracted at the top and extended at the bottom.
Figure 4:
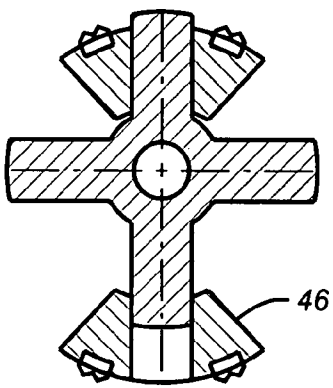
FIG. 4 is a section view along lines 4-4 of FIG. 3.

Referring to FIGS. 3 and 4 mandrel 40 has a series of ramps of which ramps 42 and 44 are shown. In the run in position on the upper part of FIG. 3 a slip 46 is shown in the run in position. Those skilled in the art will appreciate that a plurality of slips 46 are used around the periphery of the mandrel 40 and they are held to the mandrel by one or more band springs or by other means. All of the structure is not shown to allow a better focus on the interaction between mandrel 40 and a given slip 46. The actuation occurs by relative movement between the two that, in the preferred embodiment, is initiated with hydraulic pressure in passage 48 but is not limited to just pressure actuation. The actual piston assembly that creates this relative movement has also been omitted to better focus on the layout between a slip 46 and the mandrel 40 that is the present invention.

Figure 5:
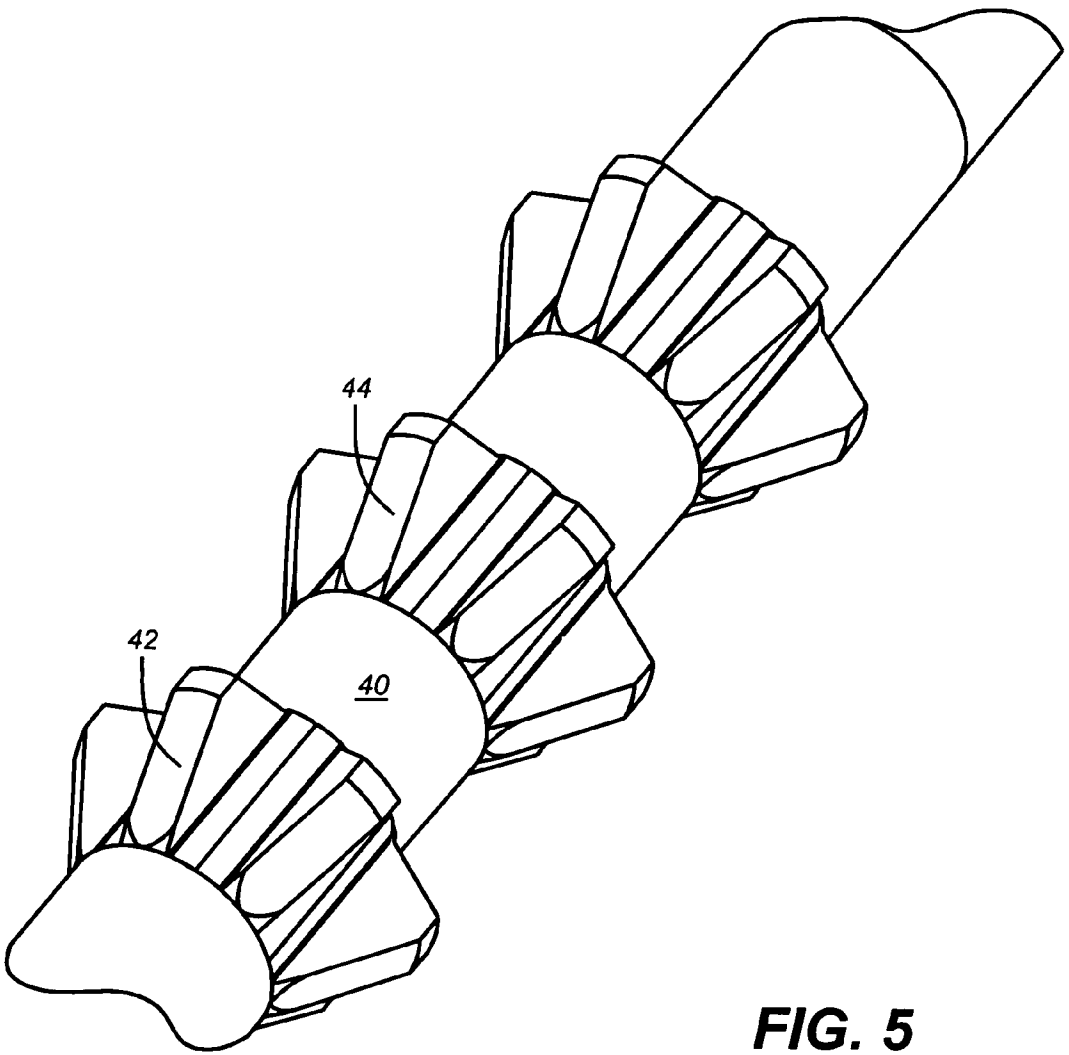
FIG. 5 is a perspective view of the mandrel without the slips.
Figure 6:
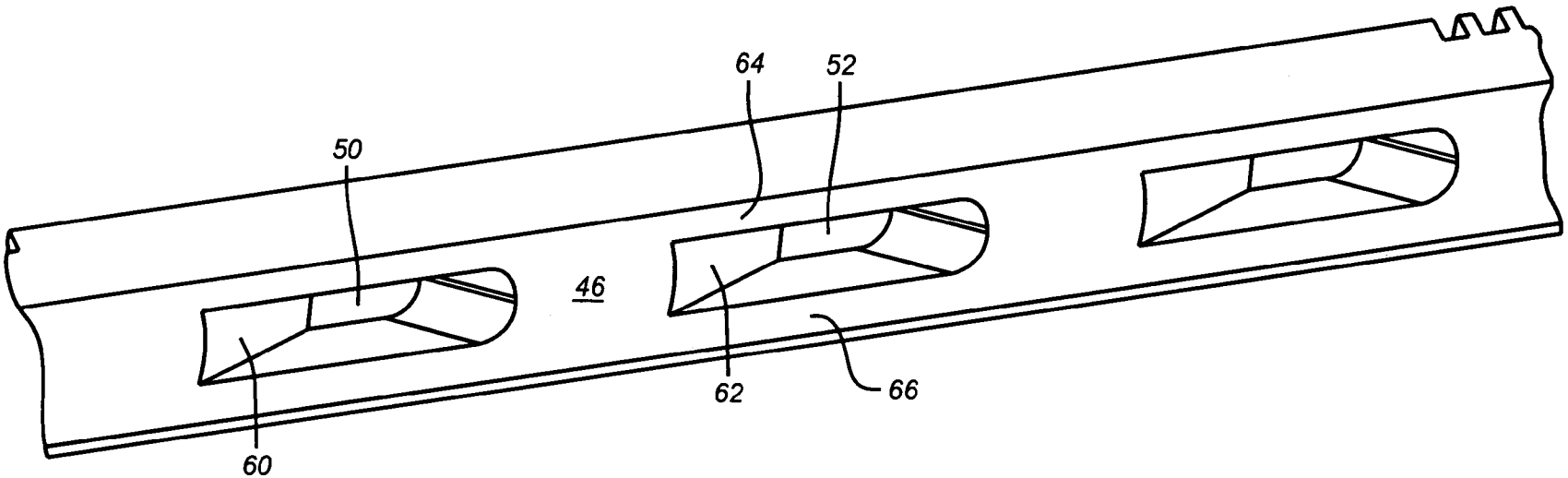
FIG. 6 is a perspective view of the underside of a slip.
Figure 7:
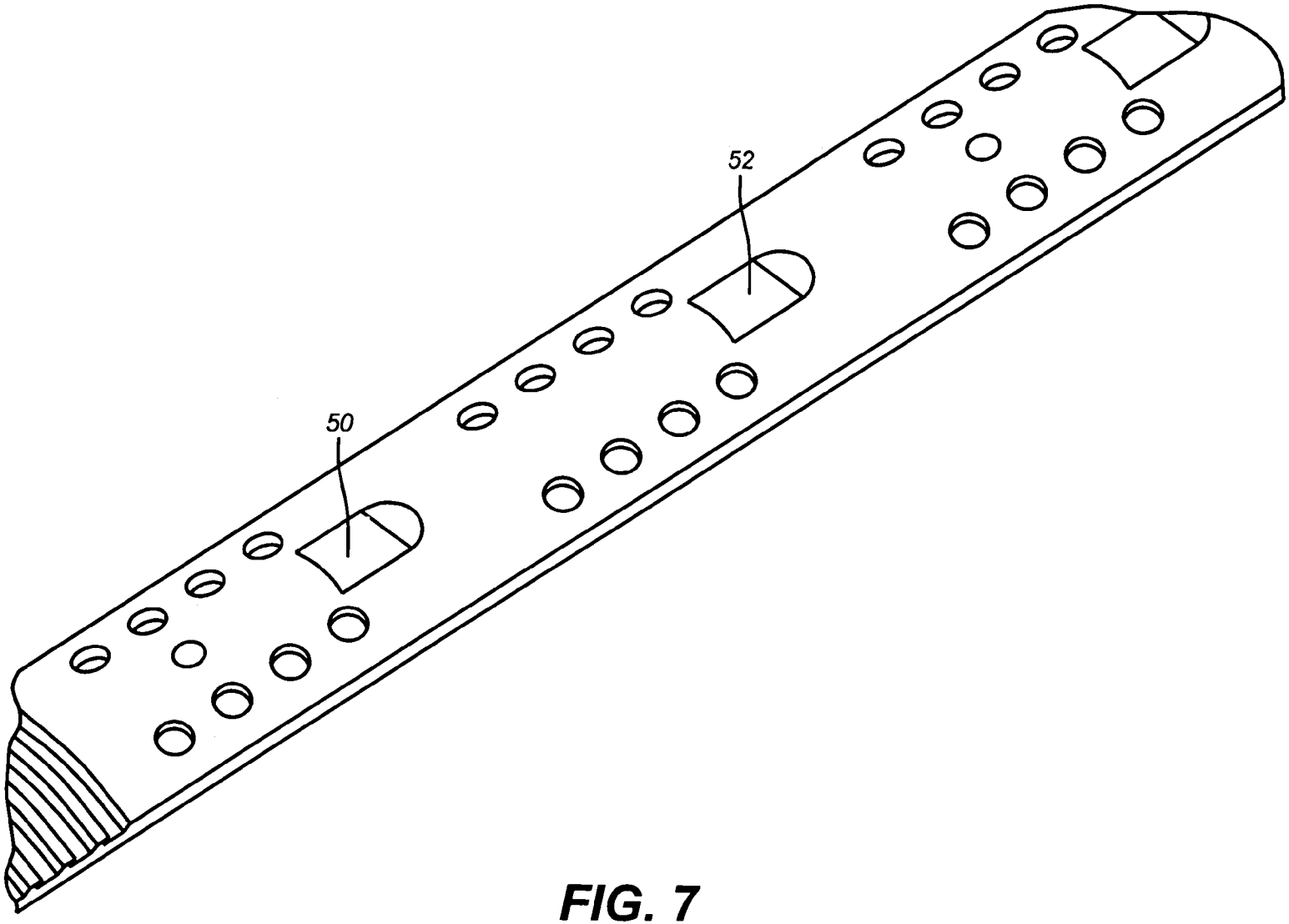
FIG. 7 is a perspective view of the gripping side of a slip.

Slip 46 has openings 50 and 52 that can also be seen in FIGS. 6 and 7. Ramps 42 and 44 can also be seen in perspective in FIG. 5.

Mandrel 40 has a series of peaks such as 54 and 56 and as shown in the run position at the top of FIG. 3 represents the greatest radial dimension of the tool during run in. Stated differently, peaks 54 and 56 extend through openings 50 and 52 in slip 46 during run in to a point further out radially than inserts 58 or equivalent structures to inserts 58. Referring again to FIGS. 3 and 6, the slip 40 has ramps 60 and 62, for example, and they ride respectively on ramps 42 and 44 of mandrel 40. Because the slip 46 uses openings 50 and 52 its overall thickness can be greater for the same sized mandrel without increasing the drift diameter required to pass the tool during run in. At the same time, on either side of an opening such as 52, for example in FIG. 6, there are wall segments 64 and 66 that with the greater thickness of slip 40 as compared to the prior design slip 10 have the strength to handle the tensile loads from uneven contact of slip 40 to a surrounding tubular or the wellbore in open hole or to handle tensile loads when the mandrel elongates due to loads applied.

Figure 1:
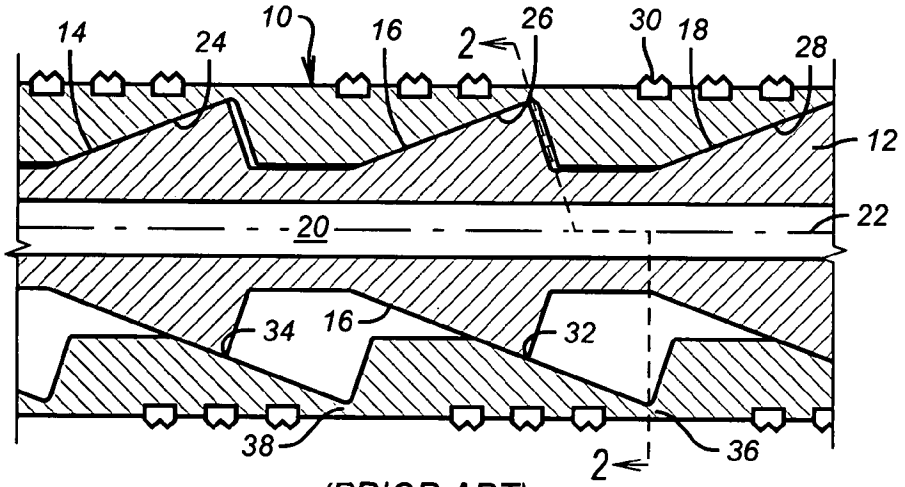
(PRIOR ART) FIG. 1
FIG. 1 is a split section view of a prior art design showing a slip in the retracted position at the top and in the extended position at the bottom.
Figure 2:
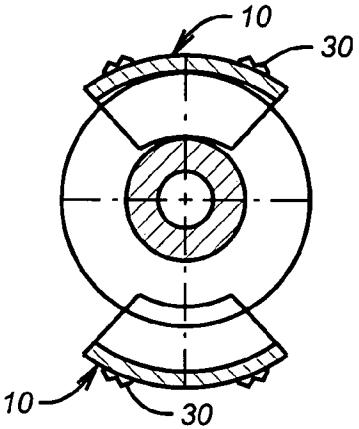
(PRIOR ART) FIG. 2
FIG. 2 is the view along lines 2-2 of FIG. 1.

In essence, the ramps 16 and 18 of the prior design, for a given angle of inclination, can now be longer, as illustrated in FIG. 3 with ramps 42 and 44. Even though the ramps are longer and as a result produce peaks 54 and 56 that are higher than peaks 32 and 34 of the prior tool for a given mandrel size, the drift dimension is not increased because the slip 46 no longer rides on top of peaks 54 and 56 as was done in the prior design. Rather, the openings 50 and 52 let the ramps 42 and 44 get longer for a given thickness of slip 46 to be able to move out further radially by having a longer set of ramps such as 60 and 62 to ride up on similarly longer counterpart mandrel ramps 42 and 44. Now, the extension of slip 46 is increased for a given mandrel size as best seen by comparing FIGS. 4 and 2 which are to the same scale. The openings allow making the slip thicker without increasing the drift dimension required for a given mandrel size. The thicker slip with openings allows more material to resist tensile stresses during setting and further radial extension for a given drift requirement than the prior design.

It should be noted that ramps 42 and 44 can be equally or unequally spaced. They can be parallel or not with respect to each other. Preferably the ramps on the mandrel 40 are parallel to their counterpart ramp on the slip 46.

The above description is illustrative of the preferred embodiment and many modifications may be made by those skilled in the art without departing from the invention whose scope is to be determined from the literal and equivalent scope of the claims below:

I claim:

1. A downhole anchor, comprising:

a mandrel having at least one mandrel ramp;

at least one slip movably mounted with respect to said mandrel ramp, said slip mounted over said mandrel ramp in the run in position while said mandrel ramp extends radially further than said slip in said run in position;

a peak is defined by the outward end of said mandrel ramp, said slip defining a wall comprising at least one opening located wholly in said wall between ends thereof through which said peak extends in said run in position.

2. The anchor of claim 1, wherein:

said slip comprises at least one slip ramp adjacent said opening.

3. The anchor of claim 2, wherein:

said slip ramp is parallel to said mandrel ramp.

4. The anchor of claim 2, wherein:

said mandrel ramps each extending for run in through a respective opening in said slip.

5. The anchor of claim 4, wherein:

said at least one slip ramp comprises a plurality of slip ramps;

said at least one opening in said slip comprises a plurality of openings with each said slip ramp adjacent a respective opening.

6. The anchor of claim 5, wherein:

said mandrel ramps are equally spaced.

7. The anchor of claim 5, wherein:

said mandrel ramps are not equally spaced.

8. The anchor of claim 5, wherein:

said mandrel ramps are parallel to each other.

9. The anchor of claim 5, wherein:

said mandrel ramps are not parallel to each other.

10. The anchor of claim 5, wherein:

each slip ramp is parallel to its counterpart mandrel ramp.

11. The anchor of claim 5, wherein:

said at least one slip comprises a plurality of slips disposed about said mandrel.

12. A downhole anchor, comprising:

a mandrel comprising a plurality of spaced apart mandrel ramps further comprising opposed sides;

a plurality of slips that each straddle and contact said opposed sides of one of said ramps for run in thereby allowing said mandrel ramps to define the run in clearance needed to run in the anchor;

said slips comprise a plurality of openings through which said mandrel ramps extend;

said slips comprise a plurality of spaced apart slip ramps in contact with a respective said mandrel ramp;

said slip ramps are located adjacent said openings;

whereupon said slips move radially on sliding action between said slip ramps on said mandrel ramps.

13. The anchor of claim 12, wherein:

said mandrel ramps are equally spaced.

14. The anchor of claim 12, wherein:

said mandrel ramps are substantially parallel.

15. The anchor of claim 12, wherein:

said slips are mounted about said mandrel and further comprise upper and lower ends that move radially uniformly as a result of said sliding action of the plurality of slip ramps on the plurality of said mandrel ramps.

* * * * *